US005165110A

United States Patent [19]

Grilliot et al.

[11] Patent Number: 5,165,110

[45] Date of Patent: Nov. 24, 1992

[54] FIREFIGHTER'S COAT PROVIDING FREEDOM OF ARM MOVEMENT

[75] Inventors: William L. Grilliot; Mary I. Grilliot, both of 1986 Home Ave., Dayton, Ohio 45417; Karl E. Senser, Camano Island, Wash.; Patricia K. Lewis, Huber Heights, Ohio

[73] Assignees: William L. Grilliot; Mary I. Grilliot, Dayton, Ohio

[21] Appl. No.: 709,178

[22] Filed: Jun. 3, 1991

[51] Int. Cl.[5] ..... A41D 13/00

[52] U.S. Cl. ..... 2/93; 2/81; 2/125

[58] Field of Search ..... 2/69, 81, 85, 93, 108, 2/125, 243 B, 243 R

[56] References Cited

U.S. PATENT DOCUMENTS

| | | | |
|---|---|---|---|
| 2,291,025 | 7/1942 | Casella | 2/93 |
| 3,719,956 | 3/1973 | Glassberg | 2/125 |
| 4,507,808 | 4/1985 | Montalto | 2/93 |
| 4,817,210 | 4/1989 | Aldridge | 2/81 |
| 4,864,655 | 9/1989 | McKenney | 2/125 |
| 5,010,591 | 4/1991 | Kalaam | 2/93 |

*Primary Examiner*—Andrew M. Falik
*Assistant Examiner*—Diana L. Biefeld
*Attorney, Agent, or Firm*—Jacox & Meckstroth

[57] ABSTRACT

A firefighter's coat which has a body section and a pair of sleeve sections. Each of the sleeve sections when attached to the body section has an upper portion provided with a given length dimension and a lower portion provided with a length dimension greater than the given length dimension of the upper portion of the sleeve section. Therefore, the arms of the firefighter who wears the firefighter's coat can be freely moved as the sleeve sections are moved without appreciable strain between the sleeve sections and the body section and without significant responsive movement of the body section of the firefighter's coat. Therefore, stress upon the firefighter as a result of arm movement is minimal.

8 Claims, 3 Drawing Sheets

FIREFIGHTER'S COAT PROVIDING FREEDOM OF ARM MOVEMENT

BACKGROUND OF THE INVENTION

As a firefighter is engaged in firefighting activity the arms of the firefighter are actively moved.

When a firefighter is wearing a conventional firefighter's coat, upward movement of the firefighter's arms results in strain or tension between the sleeve portions of the firefighter's coat and the body portions of the firefighter's coat. Such strain between the sleeve portions of the firefighter's coat and the body portions of the firefighter's coat usually causes upward movement of the body portions of the firefighter's coat with upward movement of the sleeve portions of the firefighter's coat. Such upward movement of the body portions of the firefighter's coat causes the firefighter to expend energy in excess of the energy required to raise the sleeve portions of the firefighter's coat with upward movement of the arms of the firefighter. Of course, in view of the fact that a firefighter's coat has significant weight, the energy required to raise the body portions of the firefighter's coat adds unnecessary stress to the firefighter. Also, raising the body portions of the firefighter's coat may expose unprotected portions of the torso regions of the firefighter.

Therefore, the structure of a conventional coat of a firefighter has objectionable features.

It is an object of this invention to provide a firefighter's coat having structural features which permit arm movement of the firefighter without causing significant responsive or resulting movement of body portions of the firefighter's coat. Therefore, the firefighter's arms can move without creating unnecessary stress upon the firefighter and without causing exposure of unprotected regions of the firefighter's body.

It is another object of this invention to provide such a firefighter's coat without significantly increasing the amount of material which is normally found in a firefighter's coat.

Other objects and advantages of this invention reside in the construction of parts, the combination thereof, the method of construction and the method of use, as will become more apparent from the following description.

U.S. Pat. Nos. 4,864,655 and 5,010,591 disclose firefighters' coats which reduce resistance to arm movements. However, the structural features thereof are different from the structural features of the firefighter's coat of this invention.

SUMMARY OF THE INVENTION

This invention comprises a firefighter's coat which includes firefighting protective material, such as abrasion resistant material, flame resistant material, thermal barrier material, and moisture barrier material. These materials may be in the form of one layer or a plurality of layers.

The firefighter's coat of this invention includes a body section and a pair of sleeve sections. Each of the sleeve sections has an upper part having a given length dimension and a lower part having a length dimension greater than the given length dimension of the upper part. As the firefighter's arms are raised upwardly, the sleeve sections are raised upwardly. However, due to the fact that the lower part of the sleeve sections has a greater length dimension than the length dimension of the upper part of the sleeve sections, no appreciable strain or tension occurs between the sleeve sections and the body sections. Therefore, the body section of the firefighter's coat is not raised significantly as the firefighter's arms are raised.

Therefore, the firefighter is not required to exert unnecessary energy which would occur if the body section of the firefighter's coat should be lifted with lifting of the firefighter's arms and the sleeve sections of the firefighter's coat. Therefore, the firefighter's arms can be moved freely and independently of the body section of the firefighter's coat. Thus, any stress upon the firefighter as a result of arm movement of the firefighter is primarily limited to the arm and sleeve movement of the firefighter.

DETAILED DESCRIPTION OF THE INVENTION

Figure 1:
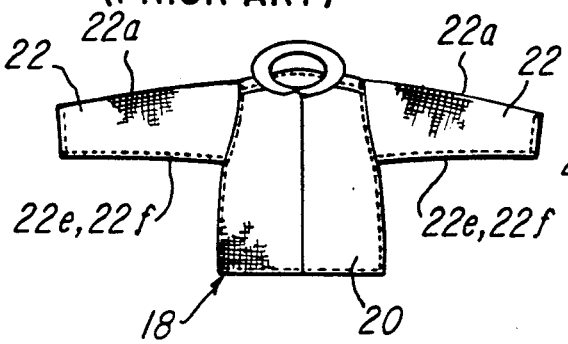
FIG-1 (PRIOR ART)
FIG. 1 is a front elevational view of a conventional or prior art firefighter's coat.
Figure 2:
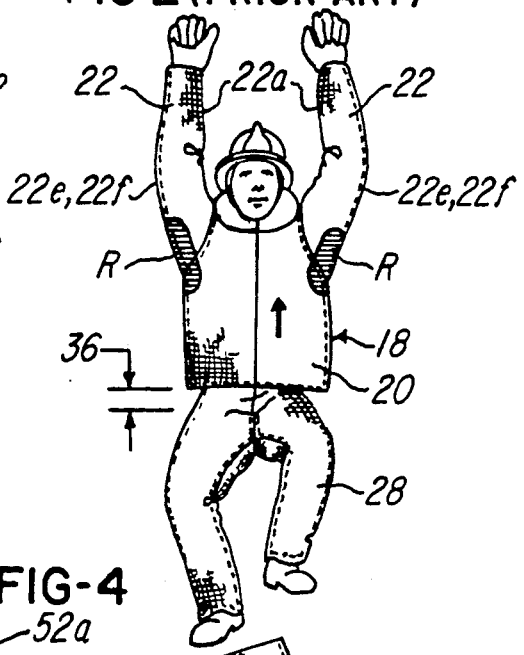
FIG-2 (PRIOR ART)
FIG. 2 is a front elevational view showing the conventional firefighter's coat of FIG. 1 as the firefighter's coat is worn by a firefighter. This view illustrates the manner by which the body section of the firefighter's coat is lifted or raised as the firefighter's arms are lifted.
Figure 3:
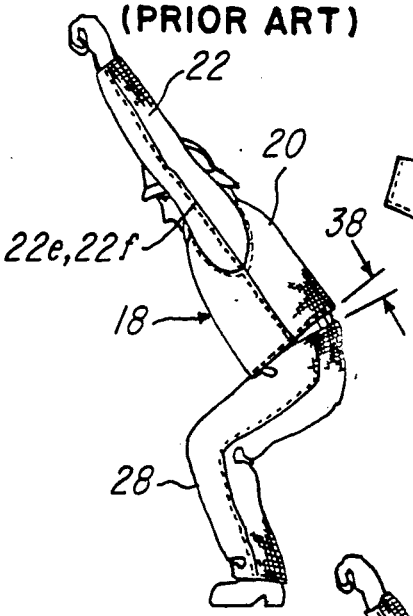
FIG-3 (PRIOR ART)
FIG. 3 is a side elevational view showing the firefighter's coat of FIGS. 1 and 2, as the firefighter's coat is worn by a firefighter. This view illustrates bending movement of the firefighter who wears the firefighter's coat and illustrates the manner in which the body section of the firefighter's coat moves as the arms of the firefighter are raised.
Figure 7:
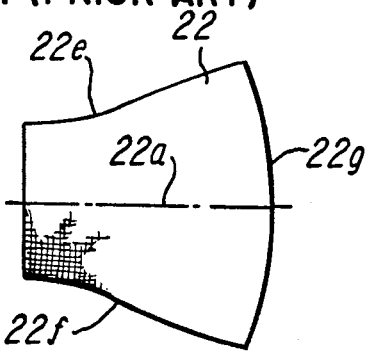
FIG-7 (PRIOR ART)
FIG. 7 is a layout type of view showing a sleeve section of the conventional prior art firefighter's coat of FIGS. 1, 2, and 3.

FIGS. 1, 2, and 3 show a conventional firefighter's coat 18. The firefighter's coat 18 of FIGS. 1, 2, and 3 has a body section 20 and sleeve sections 22. FIG. 7 shows a layout type of view of one of the sleeve sections 22 of the conventional firefighter's coat 18. FIG. 7 shows that the sleeve section 22 has an edge portion 22*e* and an edge portion 22*f*. FIG. 7 shows a line 22*a* at the central region of the sleeve section 22. FIG. 7 also shows an end part 22*g* of the sleeve section 22. The sleeve section 22 is attached to the body section 20 as the sleeve section 22 's formed into a tubular configuration and as the edge portions 22*e* and 22*f* are attached together, and as the end part 22*g* is attached to the body section 20.

The sleeve section 22 is attached to the body section 20 with the portion represented by the line 22*a* at the upper part of the sleeve section 22 and with the edge portions 22*e* and 22*f* attached together at the lower part of the sleeve 22. Therefore, each of the sleeve sections 22 has an upper part having a length dimension equal to the length of the line 22*a* and a lower part having a length dimension equal to the length of the edge portions 22*e* and 22*f*. Therefore, the length dimension of the upper part of the sleeve 22 is greater than the length dimension of the lower part of the sleeve 22.

FIG. 2 shows the firefighter's coat 18 being worn by a firefighter who also wears firefighter's trousers 28. FIG. 2 illustrates conditions during a period of time in which the firefighter's arms are raised above the firefighter's head. When this upward arm movement occurs, as illustrated in FIG. 2, a strain occurs in the firefighter's coat 18 in regions R. As illustrated, the regions R are in the lower part of the sleeve sections 22 and in the body section 20 adjacent the lower part of the sleeve sections 22. When this strain occurs there is tension in the regions R, and the body section 20 is raised, as illustrated by an arrow in FIG. 2. When the body section 20 is raised, there is relative movement between the firefighter's coat 18 and the firefighter's trousers 28, as illustrated by spaced-apart lines 36 in FIG. 2.

Furthermore, when a firefighter who wears the conventional firefighter's coat 18 bends forwardly while the firefighter's arms are raised, as illustrated in FIG. 3, the rear part of the body section 20 of the firefighter's coat 18 is raised and moved upwardly with respect to the firefighter's trousers 28. Thus, a space may occur between the conventional firefighter's coat 18 and the firefighter's trousers 28, as illustrated by spaced-apart lines 38 in FIG. 3. Such a space may expose an unprotected portion of the firefighter's body.

Therefore, the structure of the conventional firefighter's coat is objectionable.

This Invention

Figure 4:
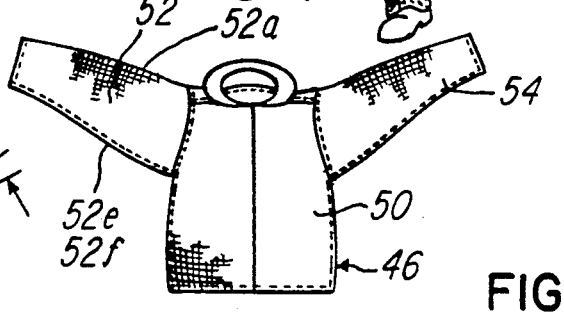
FIG. 4 is a front elevational view of a firefighter's coat which is constructed in accordance with this invention.
Figure 5:
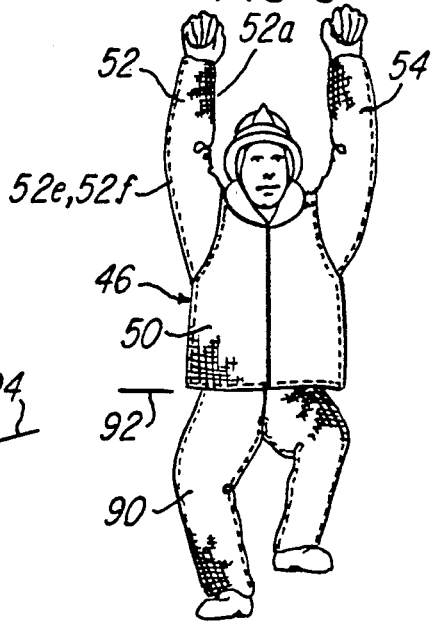
FIG. 5 is a front elevational view showing the firefighter's coat of FIG. 4 as the firefighter's coat is worn by a firefighter. This view illustrates the manner by which the body section of the firefighter's coat remains in normal position as the arms of the firefighter are raised.
Figure 6:
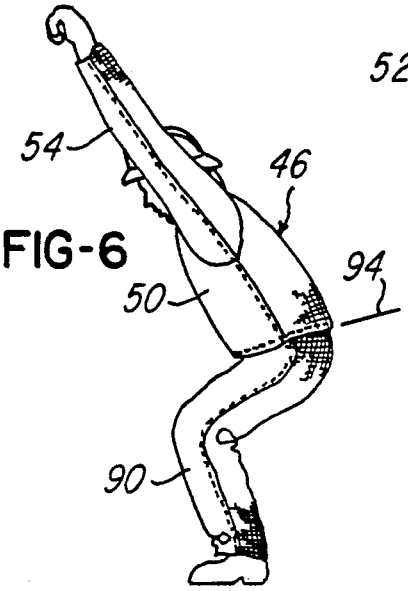
FIG. 6 is a side elevational view showing the firefighter's coat of FIGS. 4 and 5 as the firefighter's coat is worn by a firefighter. This view illustrates bending movement of the firefighter who wears the firefighter's coat and illustrates the manner by which the body section of the firefighter's coat remains substantially in normal position as the firefighter bends and as the firefighter's arms are raised.
Figure 8:
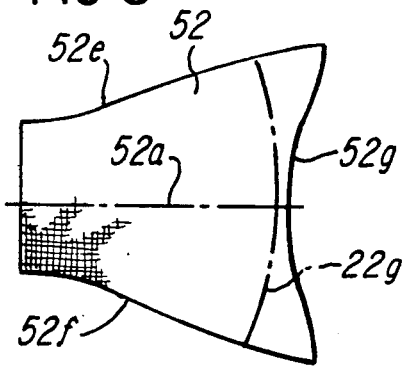
FIG. 8 is a layout type of view showing a sleeve section of a firefighter's coat of this invention. This view also illustrates the comparison between the configuration of a sleeve section of a firefighter's coat of this invention and a sleeve section of the conventional firefighter's coat of FIGS. 1, 2, and 3.

A firefighter's coat 46 of this invention is shown in FIGS. 4, 5, and 6. The firefighter's coat 46 includes a body section 50 and sleeve sections 52 and 54. FIG. 8 is a layout type of view of the sleeve section 52. A line 52*a* shown in FIG. 8 represents the center part of the sleeve section 52. The line 52*a* also represents the length dimension of the upper portion of the sleeve section 52. The sleeve section 52 has opposed edge parts 52*e* and 52*f*, as shown in FIG. 8. The sleeve section 52 also has an end part 52*g*. FIG. 8 also includes a curved line 22G which represents the end part of the sleeve section 22 of the conventional firefighter's coat 18, which is shown in FIG. 7. Thus, the difference in configuration between the sleeve section 22 of a conventional firefighter's coat and the sleeve section 52 of the firefighter's coat of this invention is illustrated in FIG. 8.

Figure 10:
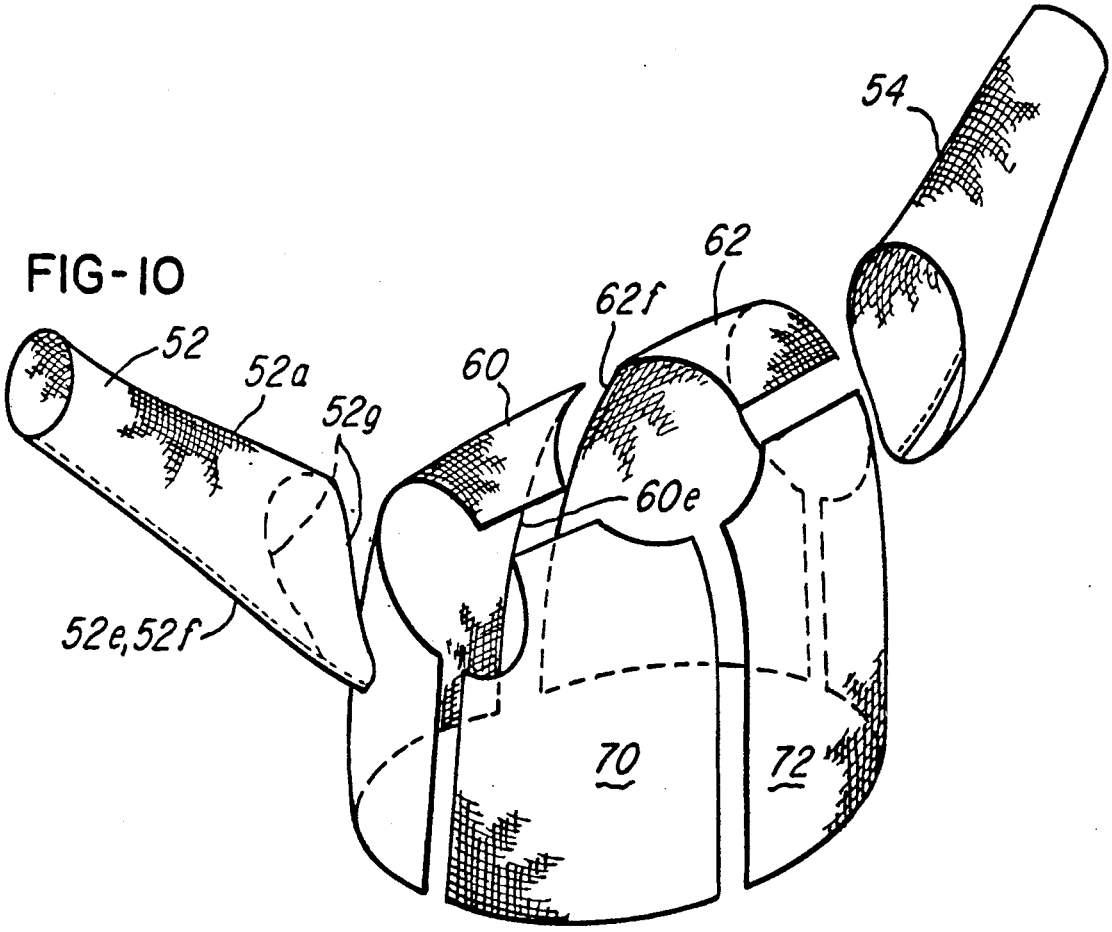
FIG. 10 is a perspective exploded view showing the body section and sleeve sections of a firefighter's coat of this invention.

FIG. 8 shows that the length dimension of the edge parts 52*e* and 52*f* is greater than the length dimension of the central portion represented by the center line 52*a*. As illustrated in FIG. 10, with the sleeve section 52 in tubular formation, the end part 52*g* of the sleeve section 52 is attached to the body section 50 with the center line 52*a* at the upper part of the sleeve section 52 and with the edge parts 52*e* and 52*f* attached together and positioned at the lower part of the sleeve section 52. Therefore, the length dimension of the upper part of the sleeve section 52 is less than the length dimension of the lower part of the sleeve section 52.

The length dimension represented by the line 52*a* in the sleeve section 52 in layout formation illustrated in FIG. 8 is preferably, but not necessarily, about one to three inches shorter than the length dimension of the edge parts 52*e* and 52*f* of the sleeve section 52 in layout formation. When the sleeve section 52 is tubular and attached to the body section 50, the length dimension 52*a*, at the upper part of the sleeve section 52 is about one-half to two inches shorter than the length dimension of the edge parts 52*e* and 52*f* which are attached together and positioned at the lower part of the sleeve section 52.

Figure 9:
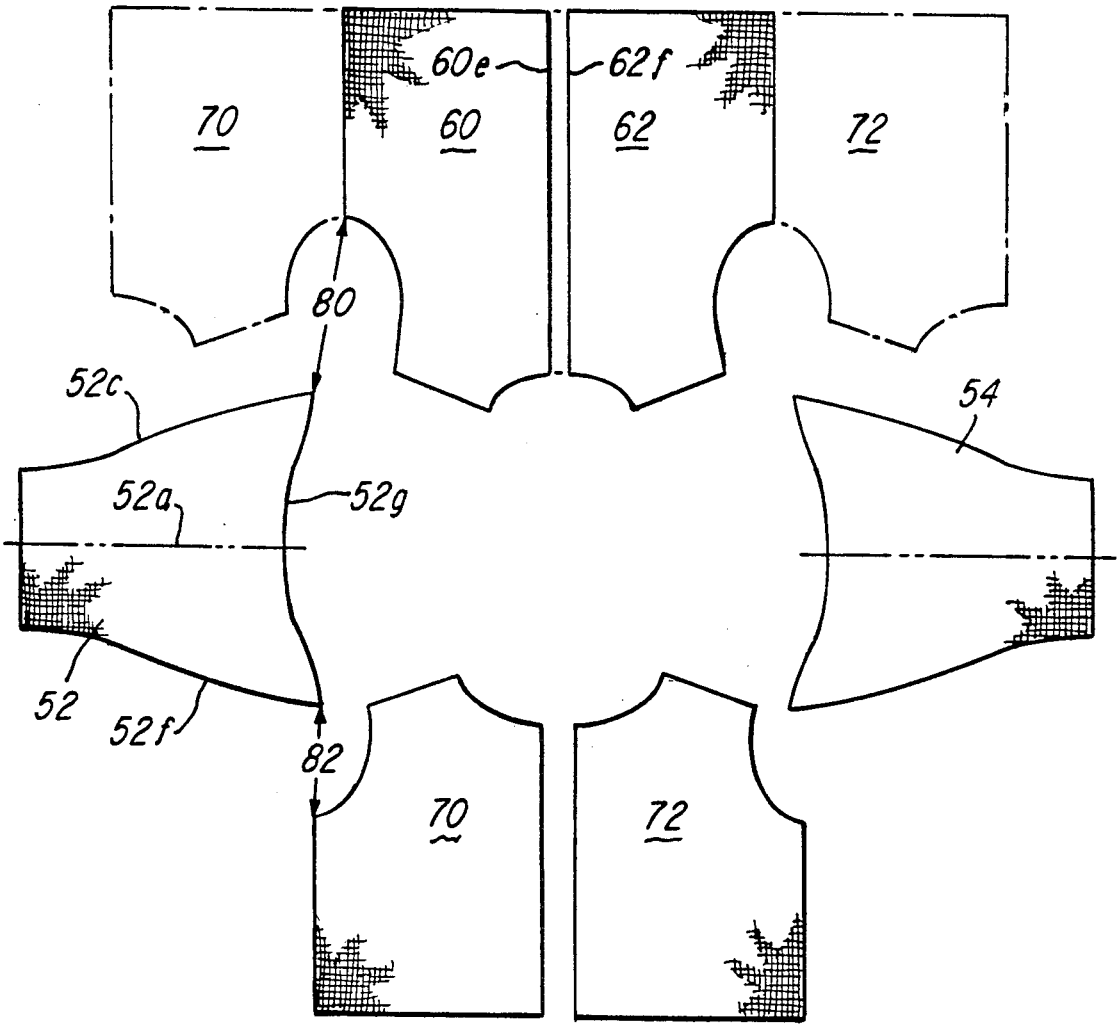
FIG. 9 is a layout type of view showing the relationship between the sleeve sections and the body section of a firefighter's coat of this invention.

FIG. 9 is a layout type of view showing back panels 60 and 62 of the body section 50 of the firefighter's coat 46. FIG. 9 also shows front panels 70 and 72 of the body section 50. The back panels 60 and 62 may be attached together along edges 60*e* and 62*f*, respectively, or the back panels 60 and 62 may comprise a single integral element. FIG. 9 also illustrates in phantom, the manner by which the front panel 70 is attached to the back panel 60 and the manner by which the front panel 72 is attached to the back panel 62. However, if desired, the front panels 70 and 72 and the back panels 60 and 62 may be a single integral piece of material or materials.

FIG. 9 also illustrates the manner by which the sleeve sections 52 and 54 are attached to the panels 60, 62, 70, and 72. A line 80 illustrates attachment of the edge part 52*e* of the sleeve section 52 to the back panel 60 and to the front panel 70. A line 82 illustrates attachment of the edge part 52*f* of the sleeve section 52 to the front panel 70. Between the edge parts 52*e* and 52*f* the end part 52*g* is attached to the front panel 70 and to the back panel 60 along the length of the end part 52*g*. A similar condition of attachment exists between the sleeve section 54 and the front panel 72 and the back panel 62.

FIG. 10 also illustrates the manner by which the sleeve sections 52 and 54 are attached to the back panels 60 and 62 and to the front panels 70 and 72.

FIGS. 5 and 6 show the firefighter's coat 46 and firefighter's trousers 90 which are worn by a firefighter. FIG. 5 illustrates the firefighter with arms and sleeve sections 52 and 54 raised above the body section 50 of the firefighter's coat 46. Due to the fact that the lower part of the sleeve sections 52 and 54 have length dimensions greater than the length dimension of the upper part of the sleeve sections 52 and 54, as the sleeve sections 52 and 54 are raised separately no appreciable strain or tension occurs between the sleeve sections 52 and 54 and the body section 50. Therefore, the body section 50 of the firefighter's coat 46 may be raised only slightly with raising of the sleeve sections 52 and 54. As illustrated by line 92 in FIG. 5, there may be no relative movement or only slight movement between the firefighter's coat 46 and the firefighter's trousers 90 as the sleeve sections 52 and 54 are raised upwardly.

FIG. 6 illustrates the firefighter bending forwardly with arms and sleeve sections 52 and 54 raised upwardly. As illustrated by a line 94 in FIG. 6, in this condition there may be no relative movement between the firefighter's coat 46 and the firefighter's trousers 90. This is due to the fact that the lower parts of the sleeve sections 52 and 54 have a length dimension greater than the length dimension of the upper parts of the sleeve sections 52 and 54.

Thus, it is understood that a firefighter who wears the firefighter's coat 46 of this invention has freedom of arm movement and freedom of movement of the sleeve sections 52 and 54, without appreciable responsive or resulting movement of the body section 50. Therefore, the firefighter does not incur additional stress which would be created if there should be significant movement of the body section 50 with movement of the firefighter's arms and sleeve sections 52 and 54. Thus, the firefighter's arms and sleeve sections 52 and 54 can move freely without creating additional stress which would result if the body section 50 should move significantly with movement of the sleeve sections 52 and 54.

Thus, it is understood that the structure of the firefighter's coat 46 of this invention is superior to the structure of the conventional firefighter's coat 18.

Although the preferred embodiment of the firefighter's coat of this invention has been described, it will be understood that within the purview of this invention various changes may be made in the form, details, proportion and arrangement of parts, the combination thereof, the method of construction and the manner of use, which generally stated consist in a firefighter's coat within the scope of the appended claims.

The invention having thus been described, the following is claimed:

1. A firefighter's coat comprising firefighting protective material including abrasion resistant material, flame resistant material, thermal barrier material, and moisture barrier material, the firefighter's coat comprising a body section and a pair of arm length sleeve sections, each of the sleeve sections including an upper portion and a lower portion, the upper portion of each sleeve section having a given length dimension, each of the sleeve sections having a lower portion, the lower portion of each sleeve section having a length dimension greater than the given length dimension of the upper portion of the sleeve section, each of the sleeve sections having a concave end part, the concave end part of each of the sleeve sections being attached to the body section, whereby as the firefighter's coat is worn by a firefighter the arms of the firefighter and the sleeve sections of the firefighter's coat can be freely moved without appreciable strain between the sleeve sections and the body section and without significant responsive movement of the body section of the firefighter's coat, whereby stress upon the firefighter as a result of movement of the firefighter's arms is minimal.

2. A firefighter's coat comprising firefighting protective material including abrasion resistant material, flame resistant material, thermal barrier material, and moisture barrier material, the firefighter's coat comprising a body section and a pair of arm length sleeve sections, each of the sleeve sections including an upper portion and a lower portion, the upper portion of each sleeve section having a given length dimension, each of the sleeve sections having a lower portion, the lower portion of each sleeve section having a length dimension greater than the given length dimension of the upper portion of the sleeve section, each of the sleeve sections having an end part, the end part of each of the sleeve sections being attached to the body section, each sleeve section in layout formation including a central part having the given length dimension and a pair of edge parts, each edge part having a length dimension greater than the given length dimension, the sleeve sections being in tubular formation when attached to the body section of the firefighter's coat, with the central part of the sleeve section being at the upper portion of the sleeve section and the pair of edge parts being attached together at the lower portion of the sleeve section, the sleeve section having an end part which has a concave curved formation, with the end part of the sleeve section attached to the body section of the firefighter's coat, whereby as the firefighter's coat is worn by a firefighter the arms of the firefighter and the sleeve sections of the firefighter's coat can be freely moved without appreciable strain between the sleeve sections and the body section and without significant responsive movement of the body section of the firefighter's coat, whereby stress upon the firefighter as a result of movement of the firefighter's arms is minimal.

3. A firefighter's coat comprising firefighting protective material including abrasion resistant material, flame resistant material, thermal barrier material, and moisture barrier material, the firefighter's coat including a body section, the body section having a sleeve attachment portion, the sleeve attachment portion having an upper part and a lower part, a pair of sleeve sections for receipt of the firefighter's arms, each sleeve section including an upper portion and a lower portion, each sleeve section also having a connection end part and a distal free end part, the connection end part of each sleeve section having a generally concave formation and being attached to the attachment portion of the body section with the upper portion of the sleeve section at the upper part of the attachment portion of the body section and with the lower portion of the sleeve section at the lower part of the attachment portion of the body section, the dimension between the upper part of the attachment portion of the body section and the distal free end part of the sleeve section being a given length dimension, and the dimension between the lower part of the attachment portion of the body section and the distal free end part of the sleeve section being a length dimension greater than the given length dimension between the upper part of the attachment portion and the distal free end part of the sleeve section, whereby as the firefighter's coat is worn by a firefighter the arms of the firefighter and the sleeve sections can be freely moved without appreciable strain between the sleeve sections and the body section and without significant responsive movement of the body section of the firefighter's coat, whereby stress upon the firefighter as a result of movement of the firefighter's arms is minimal.

4. A method of constructing a firefighter's coat comprising providing firefighting protective material which includes abrasion resistant material, flame resistant material, thermal barrier material, and moisture barrier material, forming the firefighting protective material into a body section and a pair of tubular sleeve sections in which each of the tubular sleeve sections has an upper part and a lower part, in which the lower part of each sleeve section has a given length dimension and in which the lower part of each sleeve section has a length dimension which is greater than the length dimension of the upper part of the sleeve section, forming a generally concave connection portion in each sleeve section connection portion, attaching the connection portion of each sleeve section to the body section with each sleeve section having the upper part thereof positioned upwardly and the lower part thereof positioned downwardly, whereby as a firefighter wears the firefighter's coat the firefighter's arms can be freely moved without appreciable strain between the sleeve section and the body section and without significant responsive movement of the body section of the firefighting coat, and whereby stress upon the firefighter as a result of arm movement is minimal.

5. A firefighter's coat comprising firefighting protective material including abrasion resistant material, flame resistant material, thermal barrier material, and moisture barrier material, the firefighter's coat including a body section and a pair of sleeve sections, each sleeve section having a pair of opposed spaced-apart end parts, there being an upper end part and a lower end part, the upper end part of each sleeve section being attached to the body section, the upper end part having a configuration which slopes downwardly toward the lower end part, each sleeve section including an elongate upper portion which extends from the body section and a lower elongate portion which extends from the body section, the elongate upper portion of each sleeve section extending along the length of the sleeve section from the upper end part thereof to the lower end part thereof, the upper elongate portion of each sleeve section having a given length dimension, the lower elongate portion of each sleeve section extending along the length of the sleeve section from the upper edge thereof to the lower end part thereof, the lower elongate portion having a length dimension greater than the given length dimension of the upper elongate portion of the sleeve section, whereby as the firefighter's coat is worn by a firefighter the arms of the firefighter and the sleeve sections of the firefighter's coat can be freely moved without appreciable strain between the sleeve sections and the body section, and without significant responsive movement of the body section of the firefighter's coat, whereby stress upon the firefighter as a result of movement of the firefighter's arms is minimal.

6. A firefighter's coat comprising firefighting protective material including abrasion resistant material, flame resistant material, thermal barrier material, and moisture barrier material, the firefighter's coat including a body member and a pair of sleeve members, the body member having an upper sleeve connection part and a lower sleeve connection part, each sleeve member having an upper portion and a lower portion, the lower portion of each sleeve member having a given length dimension along the length of the sleeve member, the upper portion of each sleeve member having a length dimension along the length of the sleeve member, the upper portion of each sleeve member having a length dimension which is less than the given length dimension of the lower portion of the sleeve member, the upper portion of each sleeve member having an upper edge which is attached to the upper sleeve connection part of the body member, the lower portion of each sleeve member having an upper edge which is attached to the lower sleeve connection part of the body member, the upper edge of the upper portion and the upper edge of the lower portion upper edge formation, whereby as the firefighter's coat is worn by a firefighter the arms of the firefighter and the sleeve members of the firefighter's coat can be freely moved without appreciable strain between the sleeve members and the body member and without significant responsive movement of the body member of the firefighter's coat, whereby stress upon the firefighter as a result of movement of the firefighter's arms is minimal.

7. A method of constructing a firefighter's coat comprising providing a body section having a pair of sleeve attachment portions with each sleeve attachment portion having an upper part and a lower part, forming a pair of elongate tubular sleeve sections for receipt of the arms of a firefighter, in which each of the sleeve sections include abrasion resistant material, flame resistant material, thermal barrier material, and moisture barrier material, providing each sleeve section with an upper part having a given length dimension along the length thereof, providing each sleeve section with a lower part having a length dimension along the length thereof, forming the length dimension of the lower part of the sleeve section with a length dimension greater than the given length dimension of the upper part of the sleeve section, forming a generally concave upper edge in each sleeve section, and attaching the upper edge of each sleeve section to one of the sleeve attachment portions of the body section, with the upper part of the sleeve section positioned upwardly and with the lower part of the sleeve section positioned downwardly and with the upper part of each sleeve section attached to the upper part of one of the sleeve attachment portions of the body section, and with the lower part of each sleeve section attached to the lower part of one of the sleeve attachment portions of the body section, whereby as a firefighter wears the firefighter's coat the firefighter's arms can be freely moved as the sleeve sections are moved with movement of the firefighter's arms, whereby such movement of the sleeve sections occurs without appreciable tension between the sleeve sections and the body section, and whereby the sleeve sections are moved without significant responsive movement of the body section of the firefighter's coat, whereby stress upon the firefighter as a result of arm movement is minimal.

8. A method of constructing a firefighter's coat comprising providing firefighting protective material which includes abrasion resistant material, flame resistant material, thermal barrier material, and moisture barrier material, forming the firefighting protective material into a body section provided with a sleeve attachment portion, with the sleeve attachment portion having an upper part and a lower part, forming the firefighting material into a sleeve section in layout formation in which the sleeve section has a central portion having a given length dimension, and in which the sleeve section has a pair of opposed edge portions in which each edge portion has a length dimension greater than the given length dimension of the central portion of the sleeve section, forming a generally concave end portion in the layout formation of the sleeve section, forming the sleeve section into tubular formation, attaching the edge portions together, positioning the sleeve section adjacent the body section with the central portion of the sleeve section positioned upwardly and with the edge portions of the sleeve section positioned downwardly, attaching the generally concave end portion to the upper and lower parts of the sleeve attachment portion of the body section as the sleeve section is in tubular formation with the central portion of the sleeve section attached to the upper part of the sleeve attachment portion of the body section and with the edge portions of the sleeve section attached to the lower part of the sleeve attachment portion of the body section, whereby as a firefighter wears the firefighter's coat the firefighter can have freedom of arm movement without creating appreciable strain between the sleeve sections and the body section and without significant responsive movement of the body section of the firefighter's coat and whereby stress upon the firefighter as a result of arm movement is minimal.

* * * * *

UNITED STATES PATENT AND TRADEMARK OFFICE

CERTIFICATE OF CORRECTION

PATENT NO. : 5,165,110

DATED : November 24, 1992

INVENTOR(S) : William L. Grilliot, Mary I. Grilliot, Karl E. Senser and Patricia K. Lewis It is certified that error appears in the above-identified patent and that said Letters Patent is hereby corrected as shown below:

Column 3, line 14, change "'s" to ---is---.

Column 7, line 5, after "section" delete "con-"; line 6, delete "nection portion".

Column 8, line 2, after "portion" insert ---of each sleeve member forming a generally concave---.

Signed and Sealed this

Twelfth Day of October, 1993

Bruce Lehman

*Attest:*

BRUCE LEHMAN

*Attesting Officer*

*Commissioner of Patents and Trademarks*